US010081047B2

(12) United States Patent
Glueck et al.

(10) Patent No.: US 10,081,047 B2
(45) Date of Patent: Sep. 25, 2018

(54) COOLED TOOL FOR HOT-FORMING AND/OR PRESS-HARDENING OF A SHEET METAL MATERIAL AND METHOD FOR PRODUCING A COOLING DEVICE FOR THIS TOOL

(71) Applicant: Bayerische Motoren Werke Aktiengesellschaft, Munich (DE)

(72) Inventors: Bernhard Glueck, Fuerstenfeldbruck (DE); Bernd Woelfer, Langenbach (DE)

(73) Assignee: Bayerische Motoren Werke Aktiengesellschaft, Munchen (DE)

( * ) Notice: Subject to any disclaimer, the term of this patent is extended or adjusted under 35 U.S.C. 154(b) by 0 days.

(21) Appl. No.: 14/581,342

(22) Filed: Dec. 23, 2014

(65) Prior Publication Data

US 2015/0107325 A1 Apr. 23, 2015

Related U.S. Application Data

(63) Continuation of application No. PCT/EP2013/057076, filed on Apr. 4, 2013.

(30) Foreign Application Priority Data

Jun. 27, 2012 (DE) ..... 10 2012 210 958

(51) Int. Cl.
*B21D 37/16* (2006.01)
*B21D 22/20* (2006.01)
*C21D 1/673* (2006.01)

(52) U.S. Cl.
CPC ..... *B21D 37/16* (2013.01); *B21D 22/208* (2013.01); *C21D 1/673* (2013.01); *Y10T 29/49826* (2015.01); *Y10T 29/49989* (2015.01)

(58) Field of Classification Search
CPC .... B21D 22/02; B21D 22/022; B21D 22/208; B21D 37/02; B21D 37/16; C21D 1/673
See application file for complete search history.

(56) References Cited

U.S. PATENT DOCUMENTS 3,703,093 A * 11/1972 Komatsu ..... B21D 24/16 148/647
3,870,454 A * 3/1975 Penrod ..... B29C 47/14 425/378.1

(Continued)

FOREIGN PATENT DOCUMENTS

CN 1748983 A 3/2006
CN 101090784 A 12/2007

(Continued)

OTHER PUBLICATIONS

Machine Translation, JP 64-27920 A, Jan. 30, 1989.*

(Continued)

*Primary Examiner* — Edward Tolan
(74) *Attorney, Agent, or Firm* — Crowell & Moring LLP

(57) ABSTRACT

The invention relates to a tool for hot-tanning and/or press hardening of a sheet metal material, this tool having a plurality of cooling devices through which a coolant can flow, in order thus to be able to actively cool at least regions of the effective tool surfaces which come into contact with the sheet metal material. According to the invention, at least one cooling device comprises a shell element having an effective tool surface, wherein this shell element has, on its rear side facing away from the effective tool surface, a plurality of separate cooling chambers, through which a coolant can flow, and arranged in each of these cooling chambers is at least one flow guiding element for the coolant. The invention also relates to a method for producing such a cooling device for this tool.

6 Claims, 2 Drawing Sheets

(56) References Cited

U.S. PATENT DOCUMENTS

| | | | | |
|---|---|---|---|---|
| 3,876,358 | A * | 4/1975 | Farrell | B29C 45/73 425/548 |
| 4,244,194 | A * | 1/1981 | Haesters | F25B 39/02 165/173 |
| 5,611,390 | A * | 3/1997 | Benedetti | B22D 11/055 164/418 |
| 6,209,847 | B1 * | 4/2001 | Frul | B29C 33/38 249/111 |
| 7,165,434 | B2 | 1/2007 | Vinnen et al. | |
| 8,047,037 | B2 | 11/2011 | Vehof et al. | |
| 8,118,954 | B2 * | 2/2012 | Beenken | B21D 22/022 148/639 |
| 8,245,513 | B2 * | 8/2012 | Huth | F23R 3/005 60/752 |
| 8,922,998 | B2 * | 12/2014 | Campbell | H05K 7/20272 165/154 |
| 2001/0017199 | A1 * | 8/2001 | Bommaraju | B22D 11/055 164/485 |
| 2004/0103709 | A1 * | 6/2004 | Manuel | B21D 37/16 72/342.3 |
| 2007/0227689 | A1 | 10/2007 | Green et al. | |
| 2009/0126447 | A1 * | 5/2009 | Kondo | B21D 22/02 72/347 |
| 2009/0293571 | A1 | 12/2009 | Vehof et al. | |
| 2012/0186705 | A1 * | 7/2012 | Sikora | B21D 22/02 148/516 |
| 2013/0125603 | A1 * | 5/2013 | Liu | B21D 37/16 72/342.3 |

FOREIGN PATENT DOCUMENTS

| | | | |
|---|---|---|---|
| CN | 102389917 | A | 3/2012 |
| DE | 10 2005 042 765 | A1 | 3/2007 |
| DE | 10 2007 003 745 | A1 | 7/2008 |
| DE | 10 2007 040 013 | A1 | 2/2009 |
| DE | 10 2009 058 657 | A1 | 6/2011 |
| DE | 103 41 867 | B4 | 3/2012 |
| JP | 64-27920 | A | 1/1989 |
| JP | 2006-102757 | A | 4/2006 |
| JP | 4591023 | B2 | 12/2010 |

OTHER PUBLICATIONS

Human translation; JP64-027920A, Jan. 1989.*
Chinese Office Action dated Apr. 24, 2014 (nine (9) pages).
International Search Report dated Jun. 17, 2013 (Two (2) pages).
German Search Report dated Jul. 30, 2012 with partial English translation (Ten (10) Pages).

* cited by examiner

COOLED TOOL FOR HOT-FORMING AND/OR PRESS-HARDENING OF A SHEET METAL MATERIAL AND METHOD FOR PRODUCING A COOLING DEVICE FOR THIS TOOL

CROSS REFERENCE TO RELATED APPLICATIONS

This application is a continuation of PCT International Application No. PCT/EP2013/057076, filed Apr. 4, 2013, which claims priority under 35 U.S.C. § 119 from German Patent Application No. 10 2012 210 958.7, filed Jun. 27, 2012, the entire disclosures of which are herein expressly incorporated by reference.

BACKGROUND AND SUMMARY OF THE INVENTION

The invention relates to a tool for hot-forming and/or press-hardening of a sheet-metal material. The invention furthermore relates to a method for the production of a cooling device for such a tool.

Hot-forming is generally understood to mean forming of a sheet-metal material above its recrystallization temperature. Press-hardening or mold-hardening is understood to mean forming of a previously heated sheet-metal material with simultaneous cooling (within a few seconds), with an increase in strength being brought about as a result, along with shaping of the sheet-metal material. Different method variants for hot-forming and press-hardening (for example direct and indirect press-hardening) are known from the state of the art.

Hot-forming tools and press-hardening tools are typically configured with integrated cooling devices, in order to be able to actively cool the active tool surfaces that come into direct contact with the heated sheet-metal material, and in order to be able to conduct the heat energy introduced into the tool by means of the heated sheet-metal material away from the tool in targeted manner. These cooling devices are usually cooling bores or cooling channels disposed in the tool, through which a cooling medium (particularly on the basis of water) flows, in order to thereby bring about active cooling of the active tool surfaces. With regard to the state of the art, reference is made to DE 10 2007 003 745 A1.

A tool for press-hardening of a sheet-metal material is known from DE 10 2007 040 013 A1, in which a cooling device is composed of a cooling insert having cooling channels worked into it and a lid (or shell) set onto this cooling insert, on which lid an active tool surface is also configured.

The invention is based on the task of indicating a tool for hot-forming and/or press-hardening of a sheet-metal material, having at least one cooling device integrated into the tool, which tool can be produced in simple and cost-advantageous manner.

This task is accomplished by means of a tool according to the invention. The solution for the task also extends to cover a method for the production of a cooling device for this tool. Preferred further developments and embodiments are evident, analogously for both objects of the invention, from the dependent claims and from the following explanations.

The tool according to the invention has multiple cooling devices that are integrated into the tool and through which a coolant can flow, but at least one such cooling device, in order to thereby be able to actively cool the active tool surfaces that come into direct contact with the sheet-metal material, at least in certain regions, in other words to be able to conduct heat away out of the tool. It is provided that at least one cooling device of the tool according to the invention comprises a shell element having an active tool surface or an active tool surface section configured on it, where this shell element has multiple separate cooling chambers on a rear side, facing away from this active tool surface, through which a coolant can flow, and at least one flow guide element for the coolant is disposed in each of these cooling chambers.

A defined flow through the cooling chamber, in each instance, is achieved with the at least one flow guide element. In other words, the at least one flow guide element serves to control a coolant volume stream through the cooling chamber. The flow guide elements, in each instance, are inserted into the related cooling chambers in the shell element and attached. The cooling chambers of the shell element are typically configured with different spatial contours or shaping. The flow guide elements disposed in the cooling chambers therefore have a different configuration or shaping. In particular, it is provided that individual adaptation of a cooling chamber and the flow guide elements inserted into it takes place merely by means of finishing or reworking these flow guide elements, where this working can be undertaken at any time (in other words even after the tool is already in operation). The flow guide elements can be formed from a material that can be worked in particularly simple manner, as will still be explained in greater detail below. Complicated chip-removing or cutting work, as is required for the tools known from the state of the art and their cooling devices, is therefore eliminated to a great extent. With the idea according to the invention, the production effort and costs (particularly also the material costs) are significantly reduced as compared with the concepts known from the state of the art, without any restriction in the geometric shaping possibilities for the sheet-metal material to be formed. Furthermore, time savings in the production process also occur. Repair and maintenance processes are also shorter and more cost-advantageous.

The shell element preferably has multiple cooling chambers that are configured the same and/or differently. However, the shell element can also have only a single cooling chamber. The cooling chambers of the shell element are preferably configured as separate cooling chambers through which flow can take place, in other words every cooling chamber is separately supplied with cooling medium that flows through it. Preferably, it is provided that two adjacent cooling chambers are divided by a support rib disposed between them. The support rib can also serve for supporting the shell element on a basic tool body (or the like), on which the shell element is attached. As a result, the shell stability and the pressure strength are significantly improved.

Particularly preferably, it is provided that a flow guide element configured as a one-piece body (also referred to as a flow guide body hereinafter) is provided or disposed in each cooling chamber of the shell element. Each body or flow guide body is adapted, in terms of its shaping, to the related cooling chamber in which it is positioned or inserted. Preferably, it is provided that a gap (also referred to as a flow gap hereinafter) is present or exists between the outer surface of the flow guide body and the inner wall of the cooling chamber (cooling chamber wall), at least in certain sections, through which gap the coolant can flow in defined manner, or through which gap a coolant volume stream can be guided, where the control of the coolant volume stream takes place more or less by means of the surface of the flow guide body. In order to set the flow conditions, the flow guide body can be provided, at least in certain regions, with a surface and/or coating that reduces or increases the fluid friction. Furthermore, such a flow guide body has no supporting or stabilizing function for the shell element, but rather serves only for bringing about a defined coolant volume stream in the cooling chamber in question. Such a flow guide body can furthermore also be configured or composed of multiple body elements. Furthermore, the flow through a cooling chamber can be influenced in targeted manner, using what are called turbulence promoters, in order to set a turbulent or laminar flow, for example.

Particularly preferably, it is provided that the flow guide body disposed within a cooling chamber can have the coolant flow around it all over, thereby preventing overheating of the flow guide body, among other things. In this case, a surface offset exists between the surface of the flow guide body and the cooling chamber wall. The surface offset can be uniform or constant. Preferably, however, it is provided that the surface offset is locally different.

Instead of such a flow guide body, a plurality of flow fins can also be provided, which are disposed in a cooling chamber. This will be explained in greater detail below, in connection with the figures.

Preferably, the flow guide body consists of a plastic material or of a composite plastic material (this is also meant to include resin materials and materials or composite materials similar to resins). Particularly preferably, the flow guide body is a cast plastic body. Alternatively, the flow guide body can also consist of an aluminum material or of a similar metal material. Plastic materials and aluminum materials are characterized by low weight and by easy processability and workability, and thereby the flow guide body can easily be individually adapted to the related cooling chamber.

The flow guide bodies disposed in different cooling chambers of a shell element can be connected or combined to form a structural unit, using at least one holder rail (or holder strip or the like). Attachment and position fixation of the flow guide bodies within the cooling chambers can also take place by way of the holder rail.

The shell element can be a cast metal part, where the cooling chambers are already present in the casting blank, and the cooling chamber walls remain unworked, to a great extent (in other words particularly without chip-removing reworking). In other words, the shell element, made available as a cast metal part, has unworked cooling chambers, to a great extent. However, the cooling chamber walls can be provided with a coating, for example with a plastic coating that is sprayed on. A shell element configured in this manner proves to be relatively cost-advantageous. Alternatively, the shell element can also be configured as a milled metal part, for example. In particular, it is a one-piece cast metal part or milled metal part (in other words produced in one piece).

The tool according to the invention can have a lower tool part and an upper tool part (movable relative to one another), where opposite cooling devices according to the above explanations are present both in the lower tool part and in the upper tool part, the cooling chambers of which device are, however, disposed offset relative to one another. In this way, heat stagnation points or heat nests can be avoided, and the cooling output as a whole is optimized.

The solution of the task also extends to cover a method for the production of a cooling device for use in a tool according to the invention. This production method comprises at least the following production or method steps:

production of the shell element (with the cooling chambers) as a milled metal part or as a cast metal part;

casting of a liquid plastic or metal material into the cooling chambers of the shell element, which are essentially unworked, and allowing the cast plastic or metal material to harden or cool (hardening typically takes place within a relatively short time; if necessary, the cooling chambers can be coated with a parting agent or lined with a film); and unmolding of the flow guide bodies formed by hardening or cooling from the cooling chambers, and, if necessary, individual finishing of these flow guide bodies for adaptation to the respective cooling chamber and, in particular, for setting a specifically adapted flow gap.

Furthermore, the above and following explanations with regard to the tool according to the invention apply analogously for this production method, and vice versa.

The invention will be explained in greater detail below, using the schematic figures as examples, in non-restrictive manner. The characteristics shown in the figures and/or explained below can be general characteristics of the invention, independent of concrete combinations of characteristics.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
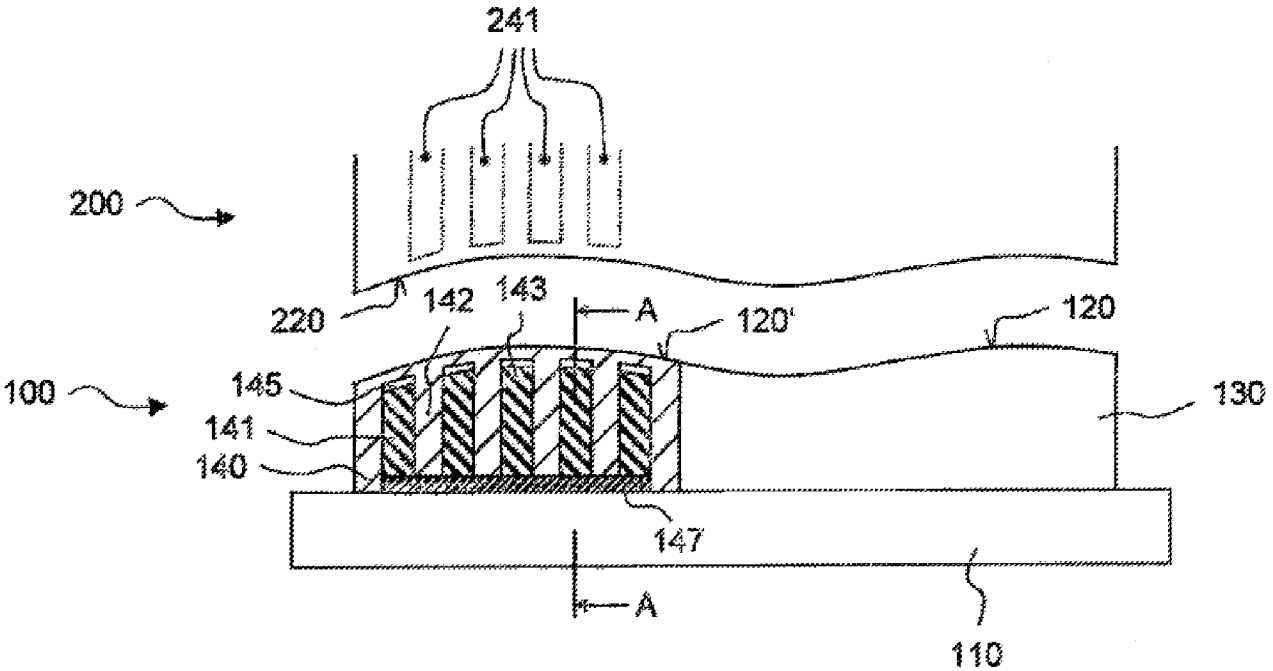
FIG. 1 shows, in a sectional view, a lower tool part belonging to a tool according to the invention.

FIG. 1 shows a lower tool part 100 that belongs to a press-hardening tool (where a hot-forming tool can have an essentially identical structure). The upper tool part 200 that belongs to the press-hardening tool, which can fundamentally have the identical structure as the lower tool part 100, is only indicated schematically. The tool parts 100 and 200 have active tool surfaces 120 and 220, between which a heated sheet-metal material can be shaped and, at the same time, cooled. The lower tool part 100 has multiple cooling devices, in order to be able to actively cool the tool surface 120 that comes into direct contact with the heated sheet-metal material. The upper tool part 200 also has such cooling devices.

These cooling devices include metallic shell elements 130 and 140 that are interchangeably attached to a basic tool body 110. In the following, the left-side cooling device will be explained in greater detail, for which purpose the shell element 140 is shown in a sectional view. The right-side cooling device with the shell element 130 is structured in comparable manner. Instead of two or more cooling devices having shell elements, only one cooling device having a shell element can also be provided on the tool according to the invention. Likewise, supplementally, other cooling devices or cooling systems known from the state of the art (for example conventional cooling bores or cooling channels) can also be provided on the tool according to the invention.

The shell element 140 has an active tool surface section 120'. Proceeding from the rear side, facing away from the active tool surface section 120', which side lies on the base body 110, multiple cooling chambers 141 extend into the shell element 140, through which chambers a cooling medium (particularly water) can flow. Each cooling chamber 141 has separate flow through it, where the inflows and outflows for the coolant that lead by way of the basic tool body 110 are not shown. The cooling chambers 141 that are adjacent to one another are divided by means of support ribs 142, where the support ribs 142 support themselves on the planar basic tool body 110 (which is shown merely as an example), thereby improving the pressure strength and the setting behavior of the shell element 140 and leading to an increase in the useful lifetime.

The cooling chambers 141 have an individual shaping and a different depth (and thereby a different volume), taking the structure of the active tool surface section 120' into consideration, where the respective depth is dimensioned in such a manner that an equal thickness distance (shell thickness) relative to the active tool surface section 120' occurs at the bottom of the recesses or cooling chambers 141, as shown. To state it in other words, this means that the cooling chambers 141 are structured close to the contour with reference to the active tool surface section 120', so that almost uniform wall thicknesses (shell thicknesses) occur over the course of the contour of the active tool surface section 120', in order to thereby achieve uniform cooling of the active tool surface section 120'. However, it is also possible to obtain an individual precision adjustment of the cooling properties (particularly for adaptation of the component properties) by means of different wall thicknesses or shell thicknesses that can be implemented relatively easily. The shell thicknesses in the region of the active tool surface section 120' can be kept very low, on the basis of the support provided by the support ribs 142, and this is advantageous for cooling of the active tool surface section 120'. Because of the support provided by the support ribs 142, the shell element can also be configured with great hardness in the region of the active tool surface section 120'.

It is provided that a core-like flow guide element 143 is disposed in each cooling chamber 141. The flow guide element 143 serves to guide the coolant through the cooling chamber 141 in defined manner, as will be explained in greater detail below. The flow guide element is a one-piece body (referred to as a flow guide body hereinafter), composed of a plastic material (or of a metal material that can be worked easily, such as aluminum, for example). Fundamentally, however, a flow guide element or flow guide body 143 can also be configured in multiple parts. Each flow guide body 143 is adapted, in terms of its shaping, to the shaping of the related or corresponding cooling chamber 141. A rod-like or rail-like connection element is referred to as 147; all the flow guide bodies 143 inserted in the shell element 140 are attached to it (for example by means of a screw connection), thereby creating a structural unit that is easy to handle.

Figure 2:
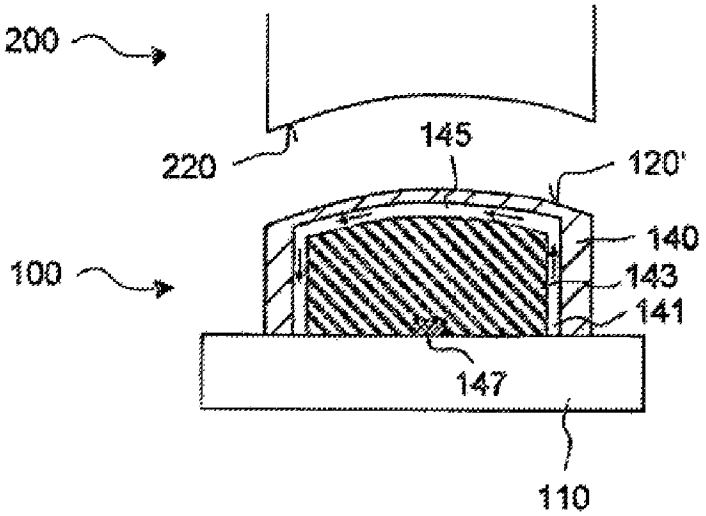
FIG. 2 shows a section through the lower tool part from FIG. 1, along the section course indicated.

FIG. 2 shows a section through the shell element 140, where this section passes through a cooling chamber 141 and the core-like flow guide body 143 inserted in it, according to the section course A-A indicated in FIG. 1. The one-piece flow guide body 143 is composed, with regard to its circumferential outer contour or circumferential contour, in such a manner that a flow gap 145 occurs between the flow guide body 143 and the opposite cooling chamber wall of the cooling chamber 141, through which gap the coolant can flow in defined manner (as illustrated with flow arrows), and thereby control of the coolant volume stream is achieved. The gap width of the flow gap 145 can be locally adapted as required, and this takes place by means of removal or application of plastic material on the flow guide body 143, if necessary. A flow channel or the like, for the coolant, can be worked into the circumferential circumference surfaces of the flow guide body 143.

The flow guide body 143 can touch the chamber wall on the face side (as shown in FIG. 1). Preferably, however, it is provided that the shaping of the flow guide body 143 is composed, with reference to the shaping of the related or corresponding cooling chamber 141, in such a manner that a constantly wide or locally differently wide flow gap 145 exists at every location or everywhere, so that the flow guide body 143 can have the cooling medium flow around it completely, in other words also on the face side. In this way, overheating of the flow guide body 143 can be effectively prevented. The flow guide body 143 is attached to the rod-like connection element 147, and is held within the cooling chamber 141 in this way, and fixed in place in the position shown. The connection element 147 can be screwed onto the shell element 140.

The upper tool part 200, which is shown only schematically in FIG. 1, can be structured in a manner comparable to that of the lower tool part 100. The cooling chambers 141 in the shell element 140 that belongs to the lower tool part 100, and the cooling chambers 241 in an opposite shell element on the upper tool part 200 are disposed offset, so that no heat nests can occur as the result of possibly insufficient cooling of the active tool surfaces 120 and 220. The offset of the cooling chambers 241 in the upper tool part 200 and of the cooling chambers 141 in the lower tool part 100 is particularly structured in such a manner that the cooling chambers of the one tool part are covered by the support ribs between the cooling chambers of the other tool part (when the tool is closed).

The cooling device described above can be produced in relatively simple, cost-advantageous, and rapid manner. The shell element 140 can be produced as a one-piece milled metal part or as a cast metal part. (If necessary, a multi-piece welded construction is also possible.) Without complicated working of the cooling chamber walls (inner walls), a liquid plastic or metal material can subsequently be cast into the cooling chambers 141, in order to thereby produce the flow guide bodies 143. For easier unmolding and/or for adjusting the flow gap 145, the cooling chambers 141 can be coated with a parting agent (or the like) or lined with a film (for example a wax film) before casting. Furthermore, pull-out bevels can be provided. After hardening or solidification, the flow guide bodies 143, particularly solid bodies, can be removed from the cooling chambers 141 and reworked, if necessary (this preferably takes place manually), where reworking of a plastic material (or aluminum material) particularly proves to be very simple, because of the weight and the material properties. The flow gap 145 between a flow guide body 143 and a related cooling chamber wall (which particularly remains unworked) can be set merely by means of working of the flow guide body 143.

Ideally, the cooling chambers 141 are already prepared or pretreated before casting, in such a manner that optimal flow gaps 145 already occur without reworking of the flow guide bodies 143. The flow guide bodies 143 can be attached to the shell element by way of the holder strip or holder rail 147, and fixed in their position.

Figure 3:
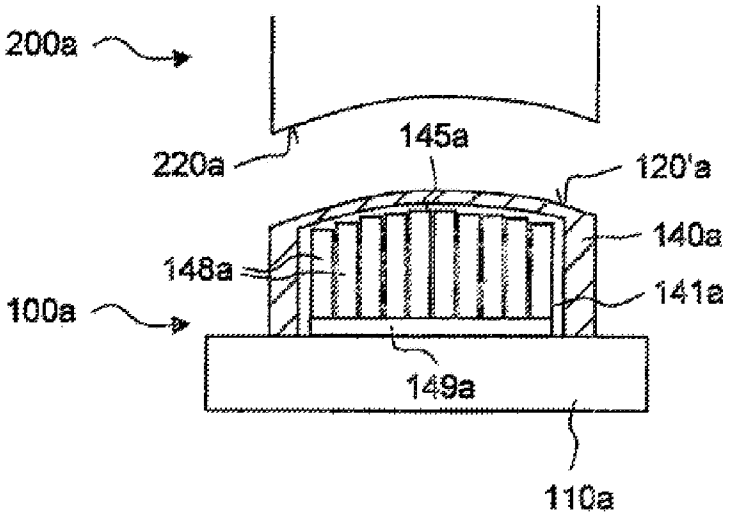
FIG. 3 shows an alternative embodiment possibility, in the same representation as FIG. 2.

FIG. 3 shows an alternative embodiment possibility of a cooling device according to the invention in the same representation as in FIG. 2. The same components are named with the same reference symbols. For differentiation, however, the letter "a" is supplementally used.

In the embodiment possibility shown in FIG. 3, a plurality of flow fins 148*a* is provided instead of a one-piece flow guide body as explained above in connection with FIGS. 1 and 2, in order to achieve control of the coolant volume stream in the cooling chamber 141*a*. The flow fins 148*a* can partly overlap. The flow fins 148*a* are produced from a metal material, for example, and are attached to a holder rail 149*a* (for example by means of welding). Alternatively, the flow fins 148*a* can also be produced from a plastic material. The fin structure is particularly suitable for small and/or narrow cooling chambers.

The cooling devices described above can be used not only in heat-forming and press-hardening tools but also in other tools such as, for example, tools for the production of CFRP components. A tool according to the invention can be used, with slight modifications, for a wet-pressing process within the course of the production of CFRP components, where the cooling devices can be repurposed to act as an oil-operated or water-operated heating device.

REFERENCE SYMBOL LIST

Cooled tool for hot-forming and/or press-hardening of a sheet-metal material, and method for the production of a cooling device for this tool

100 lower tool part
110 basic tool body
120 active tool surface
130 shell element
140 shell element
141 cooling chamber
142 support rib
143 flow guide body
145 flow gap
147 holder rail
148*a* flow fin
149*a* holder rail
200 upper tool part
220 active tool surface
241 cooling chamber The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A tool for hot-forming and/or press-hardening of a sheet-metal material, the tool comprising:

a base; and multiple cooling devices through which coolant flows to cool active tool surfaces in direct contact with the sheet-metal material, at least one of the multiple cooling devices comprising:

a shell element having an a contoured active tool surface section, wherein the shell element defines a plurality of separate cooling chambers opposite the active tool surface section, wherein the shell element is configured to be removably attached to the base; and a flow guide, comprising: a plurality of non-hollow flow guide elements, each disposed in a corresponding one of each of the cooling chambers, and a rail connecting each of the flow guide elements so as to form a unitary structure therewith, wherein the shell element and a circumferential outer contour of the flow guide element defines a gap within the cooling chamber through which the coolant flows to cool that active tool surface in direct contact with the sheet metal, wherein the cooling chambers are structured to form an essentially uniform wall thickness over the course of the contoured active tool surface, wherein two adjacent cooling chambers, of the plurality of separate cooling chambers, are divided by a support rib disposed between them, wherein the rail is configured to be coupled and decoupled to the shell element, and wherein each of the non-hollow flow guide elements is configured to be removable from corresponding cooling chambers via decoupling of the rail from the shell element subsequent to removal of the shell element from the base.

2. The tool according to claim 1, wherein at least one flow guide element is configured as a one-piece flow guide body.

3. The tool according to claim 2, wherein the flow guide body is formed from a plastic material or from a composite plastic material.

4. The tool according to claim 2, wherein the flow guide body is formed from an aluminum material.

5. The tool according to claim 1, wherein the shell element is a cast metal part.

6. The tool according to claim 1, wherein the tool comprises a lower tool part and an upper tool part, wherein opposite ones of the multiple cooling devices are situated in the lower tool part and in the upper tool part, respectively, the cooling chambers of such devices being disposed offset relative to one another.

* * * * *